US006685118B1

(12) United States Patent
Williams, Jr.

(10) Patent No.: US 6,685,118 B1
(45) Date of Patent: Feb. 3, 2004

(54) TWO ROLL CRUSHER AND METHOD OF ROLLER ADJUSTMENT

(76) Inventor: Robert M. Williams, Jr., 9721 Litzinger Rd., Ladue, MO (US) 63124

( * ) Notice: Subject to any disclaimer, the term of this patent is extended or adjusted under 35 U.S.C. 154(b) by 55 days.

(21) Appl. No.: 09/946,564

(22) Filed: Sep. 5, 2001

Related U.S. Application Data

(60) Provisional application No. 60/256,763, filed on Dec. 19, 2000.

(51) Int. Cl.[7] ..... B02C 4/32

(52) U.S. Cl. ..... 241/232; 241/285.3; 241/287

(58) Field of Search ..... 241/235, 236, 241/79, 242, 243, 232, 233, 285.3, 287

(56) References Cited

U.S. PATENT DOCUMENTS

| | | | | |
|---|---|---|---|---|
| 2,713,460 A | * | 7/1955 | Atkinson | 241/8 |
| 3,445,070 A | | 5/1969 | Verdier | |
| 3,700,182 A | | 10/1972 | Dediemar et al. | |
| 3,938,732 A | | 2/1976 | Schrimper et al. | |
| 4,074,866 A | | 2/1978 | Meder | |
| 4,168,806 A | | 9/1979 | Jakobs | |
| 4,192,471 A | | 3/1980 | Beckman et al. | |
| 4,288,039 A | | 9/1981 | Waskow | |
| 4,339,083 A | * | 7/1982 | Linzberger et al. | 241/37 |
| 5,154,364 A | | 10/1992 | Ketting | |
| 5,722,605 A | | 3/1998 | Finken | |
| 5,816,511 A | | 10/1998 | Bernardi et al. | |

OTHER PUBLICATIONS

Author: Williams Patent Crusher & Pulverizer Co. Bulletin 915 titled "Roll Crushers—Heavy Duty, Single and Double Roll Crushers" (undated), pp. 1 through 4.

* cited by examiner

*Primary Examiner*—Mark Rosenbaum
(74) *Attorney, Agent, or Firm*—Polster, Lieder, Woodruff & Lucchesi, L.C.

(57) ABSTRACT

A roll crusher having a box-like main frame, a material inlet and material outlet, a first rotatable crushing roll on the frame and a second rotatable crushing roll mounted on a roll carriage in an opposed, spaced apart relationship to the first crushing roll defining a material crushing gap. The roll carriage is a generally rectangular frame positioned atop the main frame having one end attached to the main frame near the midpoint of the main frame by pivot. The pivot is asymmetrically positioned relative to the axes of the crushing rolls. An actuator between the main frame and the free end of the roll carriage moves the roll carriage about the pivot to adjust the gap between the first and second rolls. The jack can be equipped with a servo motor responsive to a computer program.

27 Claims, 9 Drawing Sheets

TWO ROLL CRUSHER AND METHOD OF ROLLER ADJUSTMENT

CROSS REFERENCE TO RELATED APPLICATIONS

This application claims priority to provisional patent application Ser. No. 60/256,763 filed Dec. 19, 2000.

BACKGROUND OF THE INVENTION

The invention relates generally to crushers and, more particularly to a roll crusher having an improved apparatus for adjusting the crushing gap and a method of adjusting the rollers to change the size of the crushed material.

Generally speaking, roll crushers are employed to crush solid material, such as rock or coal. Two roll crushers consist of two parallel rotating crushing rolls, which are spaced apart an amount corresponding to the desired product or particle size of the crushed material. The rolls are driven in opposite directions so that the material to be crushed is drawn into the rolls and discharged from the crusher. The material can be discharged onto a conveyer or other appropriate apparatus for receiving or removing the crushed material. The material also can be conveyed to sizing screens of a particular mesh to separate product of a desired size.

To adjust particle size of the crushed product, the distance between the two rolls, referred to as the crushing gap or nip, is adjusted. To obtain crushed particles of generally smaller size, the gap between the two rolls is reduced in width. To obtain larger crushed particles, the gap is widened. In conventional two roll crushers, one roll is mounted on the crusher frame so as to be moveable toward or away from a stationary roll in a horizontal plane. In general, the movable roll is positioned on a frame and urged toward a fixed roll by springs. Springs are used so that uncrushable material can pass through the crusher by momentarily enlarging the gap between the rolls without damaging the crusher. The spacing between the rolls is varied and maintained by the placement of shims.

The space between the rolls is adjusted not only to change the crushed particle size, but also to retain uniform spacing in the event the rolls wear down. In any event, heretofore the known procedures for adjusting the crushing gap require a shut down of the crusher resulting in downtime, take considerable time and effort, and require the use of rather elaborate springs, shims and hydraulic rams.

SUMMARY OF THE INVENTION

It is among the several objects of the present invention to provide a two roll crusher having an improved mechanism for adjusting the crushing gap between the opposed crushing rolls.

Another aspect of the present invention to provide a two roll crusher in which the crushing gap between the opposed crushing rolls can be adjusted by a relatively easy, rapid and safe method.

Another aspect of the present invention to provide a roll crusher in which the principles for adjusting the crushing gap can be imparted to a single roll crusher, if desired.

In accordance with the invention, briefly stated, an improved two roll crusher is provided having a box-like main frame and a housing on the frame with a material inlet and a crushed material discharge outlet. A first motor driven crushing roll is rotatably mounted on the frame within the housing. A second crushing roll is mounted on a roll carriage and also positioned within the housing. The first and second crushing rolls are in an opposed, spaced apart relationship defining a material crushing gap between the first and second rolls. The roll carriage is a generally rectangular frame position atop the main frame. One end of the roll carriage is attached to the main frame near the midpoint of the main frame by pivot. The opposite end of the roll carriage is free. The pivot connecting the crushing roll carriage to the main frame is asymmetrically positioned on the main frame relative to the rotational axes of the crushing rolls. More specifically, the pivot is positioned nearer to the first crushing roll than to the second crushing roll.

An actuator, which in the illustrated embodiment is a worm screw jack, is mounted between the main frame and the free end of the roll carriage. The actuator is used to move the roll carriage about the pivot. Because the pivot is asymmetrically positioned, as the roll carriage is pivoted up, the second crushing roll mounted on the roll carriage moves in an upward arc toward the first crushing roll, thereby decreasing the crushing gap between the first and second crushing rolls. Likewise, a lowering of the roll carriage moves the second crushing roll away from the first crushing roll to widen the crushing gap. The operator can precisely manipulate the actuator to effect known incremental changes in the gap size.

The actuator can be equipped with a servo motor. The servo motor can operate the actuator in response to operator commands or in response to a computer program which, in a closed loop system, appropriately actuates the servo motor in response to the size of crushed material which is sampled along the closed loop, preferably at a sizing screen apparatus. Hence, in the closed loop system, the crushing gap can be adjusted, automatically, in response to crushed material sample size so as to maintain a desired crushed product size.

These and other aspects and advantages of the invention will be apparent to one skilled in the art upon review of the following specification and accompanying drawings.

DESCRIPTION OF THE PREFERRED EMBODIMENT

Figure 1:
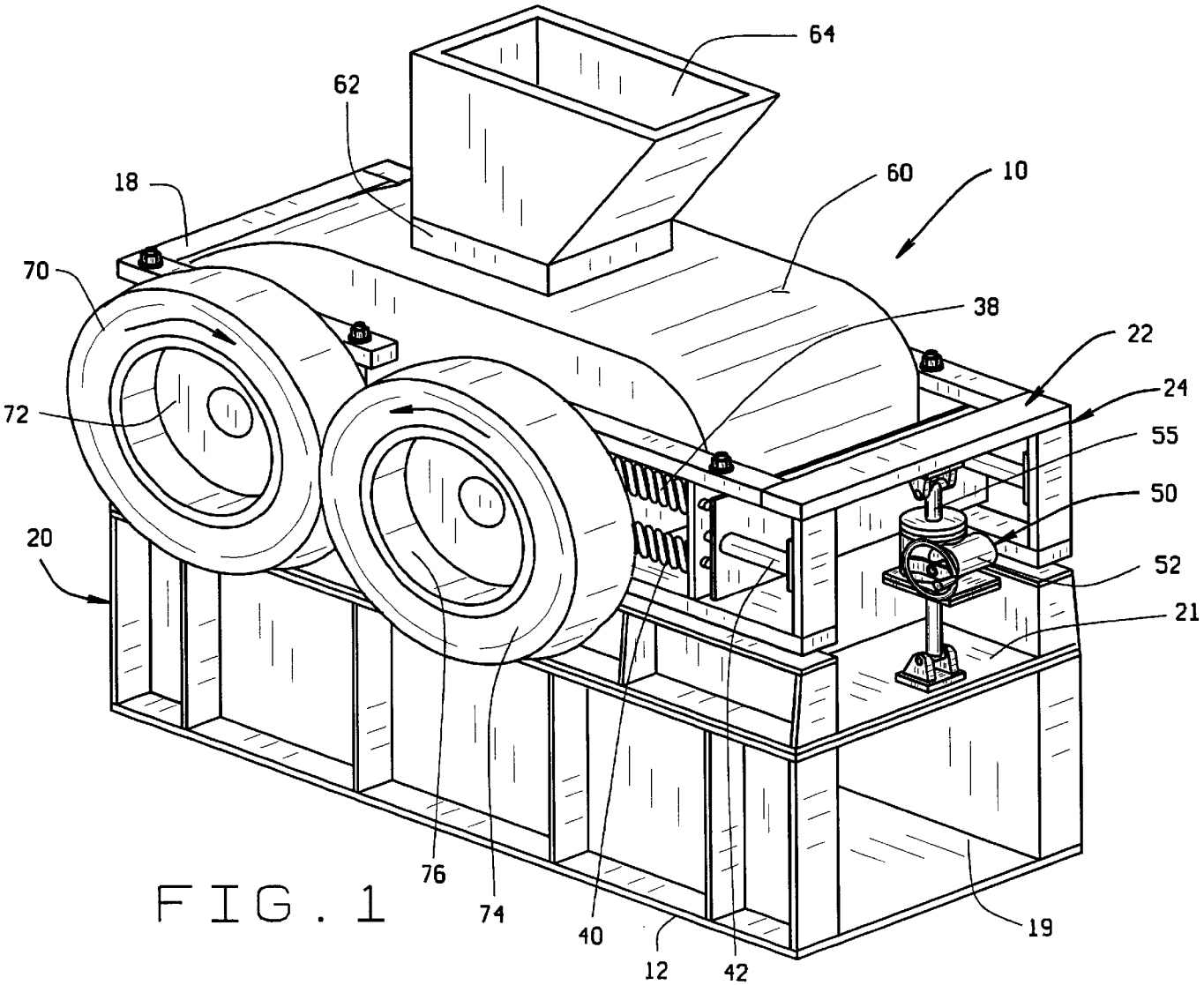
FIG. 1 is a isometric view of the improved two roll crusher of the present invention with the roll carriage in a slightly elevated position.
Figure 2:
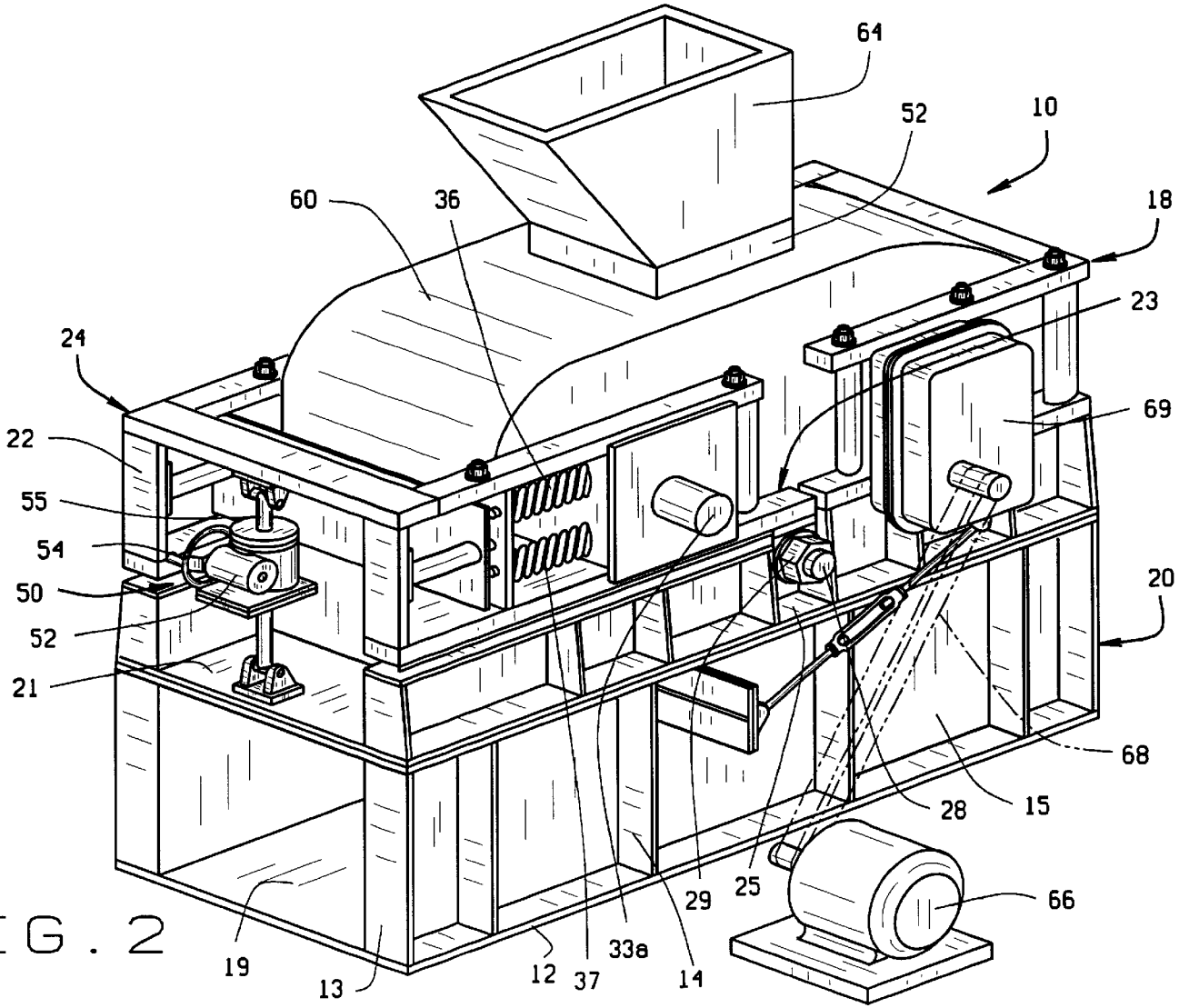
FIG. 2 is another isometric view of the improved two roll crusher.

A novel roll crusher of the present invention is indicated generally by reference numeral 10 in the drawings. Roll crusher 10 includes main frame 12, which, in general, has a box-like configuration with a base section 13 including a steel beam skeleton 14 and rolled plate side walls 15, a midsection 16 also having a framework 17 and, at one end, an upper framework 18. The main frame 12 defines a discharge opening and, as shown, main frame 12 includes open ends 19, 20 which allow a conveyer (FIG. 7) or other removal apparatus to be positioned within the frame to collect discharged material. As seen in FIGS. 1 and 2, midsection 16 includes at least one cross-member 21. The precise construction of the described frame sections is incidental to the instant invention.

A roll carriage 22 is positioned atop midsection 16 of the frame at the end opposite the upper framework. Roll carriage 22 generally is a rectangular framework, similar in construction and appearance to the upper framework 18. The forward end 23 the end of roll carriage 22 is positioned near the midpoint of crusher. The roll carriage frame has an attachment flange 25 which extends down from the bottom corner on one side of the forward end of the carriage, and a second attachment flange 26 which extends down from the opposite bottom corner on the forward end of the carriage. Hence, when the carriage 22 is in position there is an attachment flange on each side of the midsection of the main frame. Each flange has an opening (not seen) in its center. The roll carriage 22 is attached to the main frame 12 by a pivot axle 28 extending through flange 25 and flange 26 and secured in place by nuts 29 on threaded ends of the pivot axle 28, or by other acceptable structure.

A first crushing roll 30, having concentric shaft 30*a*, is mounted on the upper framework 18 in a manner known to the art. That is, the shaft 30*a* is appropriately journaled in bearings 31 and 32 to permit free rotation of the roll. A second crushing roll 33, having a concentric shaft 33*a*, is appropriately mounted in roll carriage 22 with each end of shaft 33*a* journaled in bearings 34 and 35. The first and second crushing rolls 30 and 33 respectively, are positioned in an opposed, spaced apart relationship defining a material crushing nip or gap G between the first and second rolls. Gap G can be any desired dimension. Generally, however, the spacing between the rolls ranges from ⅛ inch to 1 inch. The crushing rolls may have a smooth exterior surface or may toothed, depending upon the application. Crushing roll 33 is spring biased toward roll 30 by springs 36, 37, and 38, 40 positioned at mounting plates for bearings 34 and 35 respectively. Roll 33 is appropriately restrained from linear movement toward roll 30 by stop plates or other means. Consequently, roll 33 is a predetermined distance from roll 30. The recited springs are positioned between roll 33 and the hydraulic rams 42 and 44 so as to set the appropriate spring tension on the springs to control deflection of roll 33 when uncrushable material is introduced between the rolls.

An actuator mechanism, indicated generally by reference number 50, is securely mounted between free end 24 of the carriage 22 and the frame work. In the illustrative embodiment, the bottom of the actuator mechanism is mounted on cross-member 21 and the top is attached to the roll carriage. As shown, actuator 50 is a hand operated jack 52 of conventional worm gear design. The jack 52 has a hand wheel 54 positioned for convenient access by an operator. Turning of hand wheel 54 in the appropriate direction causes the jack shaft 55 to rise and to urge the carriage 22 upwardly. It will be understood that because the pivot point of the carriage 22 is asymmetrically position, as described above, the crushing roll 33 carried on the carriage 22 not only will move upwardly but also will move toward the opposed crushing roll 30 in a predetermined arc. The carriage 22 also can be lowered by reversing the jack to lower free end 24 of the carriage, moving the roll 33 away from roll 30. As will be explained in greater detail below, the operator can adjust gap G simply by raising or lowering carriage 22 via the actuator.

It is possible to determine the exact number of revolutions of the jack hand wheel required to move roll 33 a given increment of distance toward roll 30. For purposes of illustration only, it could be established, for example, one revolution of hand wheel 54 moves crushing roll 33 one-eighth (⅛) inch. In that illustrative scenario, if the operator desired to adjust the crushing gap G by ⅛, he would rotate hand wheel 54 one revolution in the appropriate direction. Hence, the novel two roll crusher of the present invention allows for the precise, easy and efficient adjustment of the crushing gap G.

Although the actuator is shown as a jack, it will be understood that other embodiments of an actuator are contemplated by the present invention. Other examples are hydraulically operated piston mechanisms or lifts, or other types of jack assemblies such as a scissors jack. Hence, the appended claims are intended to encompass any type of actuator that can effect the pivotal movement of the roll carriage 22 about pivot 28.

The crushing area of crusher 10, which includes crushing rolls 30, 33, can be exposed, but preferably is covered by a housing or shroud 60. The shroud 60 can have any configuration that encloses the crushing area, including the rolls. The shroud 60 includes an material inlet opening 62, which is positioned above the crushing gap G, for introduction of material to the crushing area. In the illustrated embodiment, the material inlet opening 62 includes an optional hopper 64. Likewise, the shroud would include a discharge opening (not shown) on its bottom side, positioned within the main frame 12.

Figure 5:
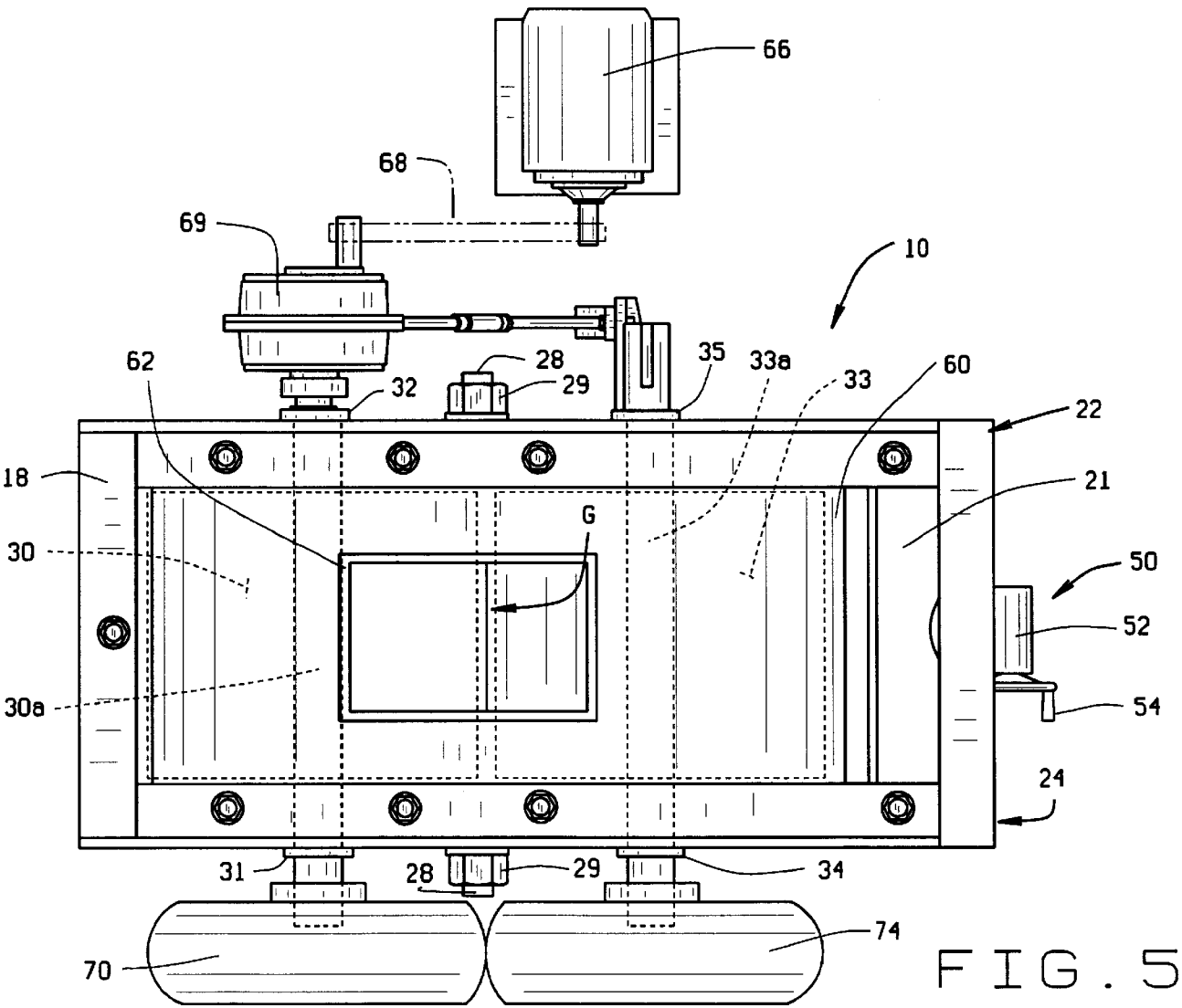
FIG. 5 is a top plan view thereof.
Figure 6:
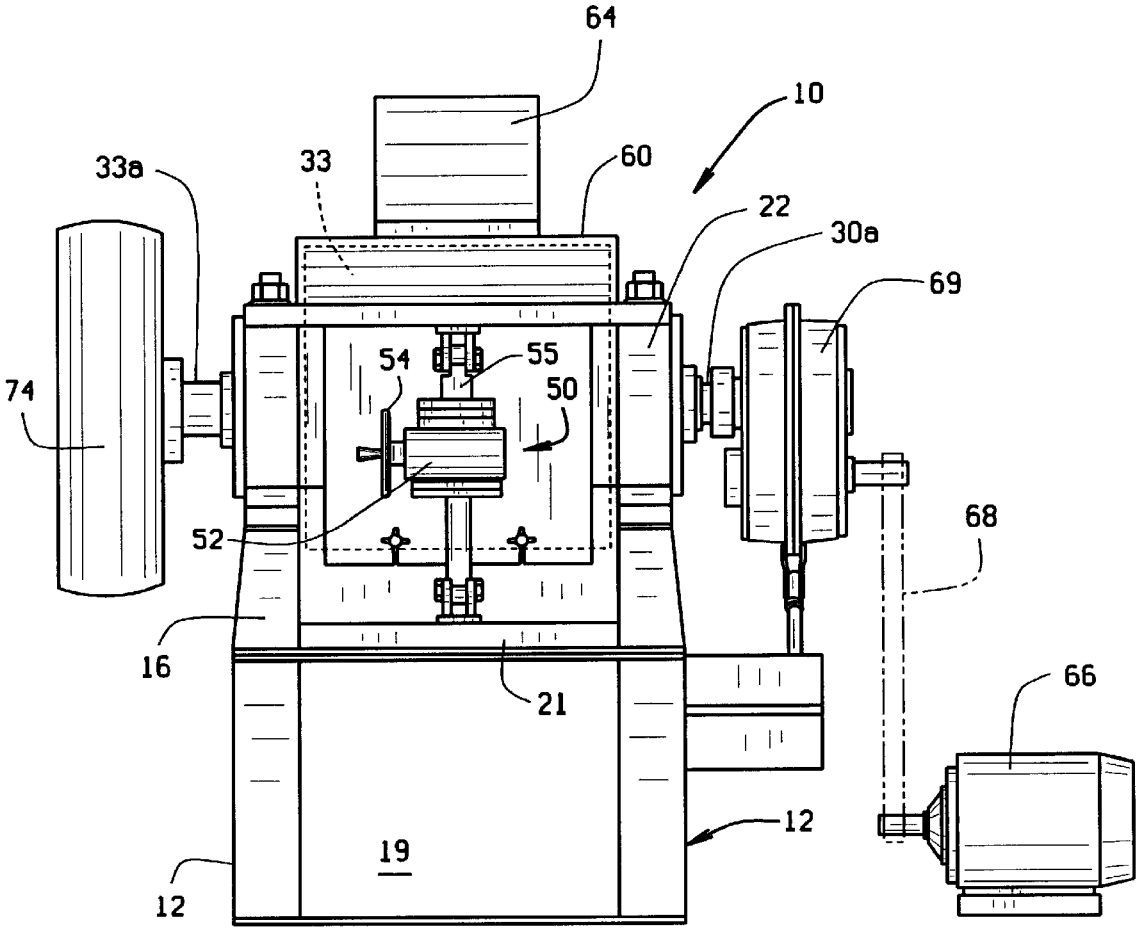
FIG. 6 is an end plan view thereof.

The opposed crushing rolls 30, 33 perform their crushing operation in typical fashion. Fixed crushing roll 30 is driven by a conventional electric motor 66, such as a 10 horsepower, 1200 rpm, class F motor. Motor 66 is connected by a belt drive 68 to a shaft-mounted reducer 69 on one end of shaft 30*a*. The motor 66 thus drives roll 30 about its axis at the appropriate rpm's in the operative direction. As shown in FIGS. 1 and 5, there is a first tire 70 on a shaft-mounted wheel 72 mounted on the opposite end of shaft 30*a*. There is a second tire 74 on a shaft-mounted wheel 76 on the corresponding end of the shaft 33*a*. The recited tires are in frictional contact so that when roll 30 rotates about its axis, tire 70 effects rotation of tire 74 and crushing roll 33, in the opposite direction (FIG. 1). Material for crushing is directed toward crushing gap G through material inlet opening 62. The oppositely rotating crushing rolls 30, 34 crush the material impinged between the rolls. The crushing material is discharged out of the bottom of the crusher and collected or conveyed away. The crushed material can be sampled for size. In the event the operator desires crushed material of a different size, or in the event the rolls wear, he can adjust the dimension of the crushing gap G, as follows, without interrupting operation of the crusher.

Figure 7:
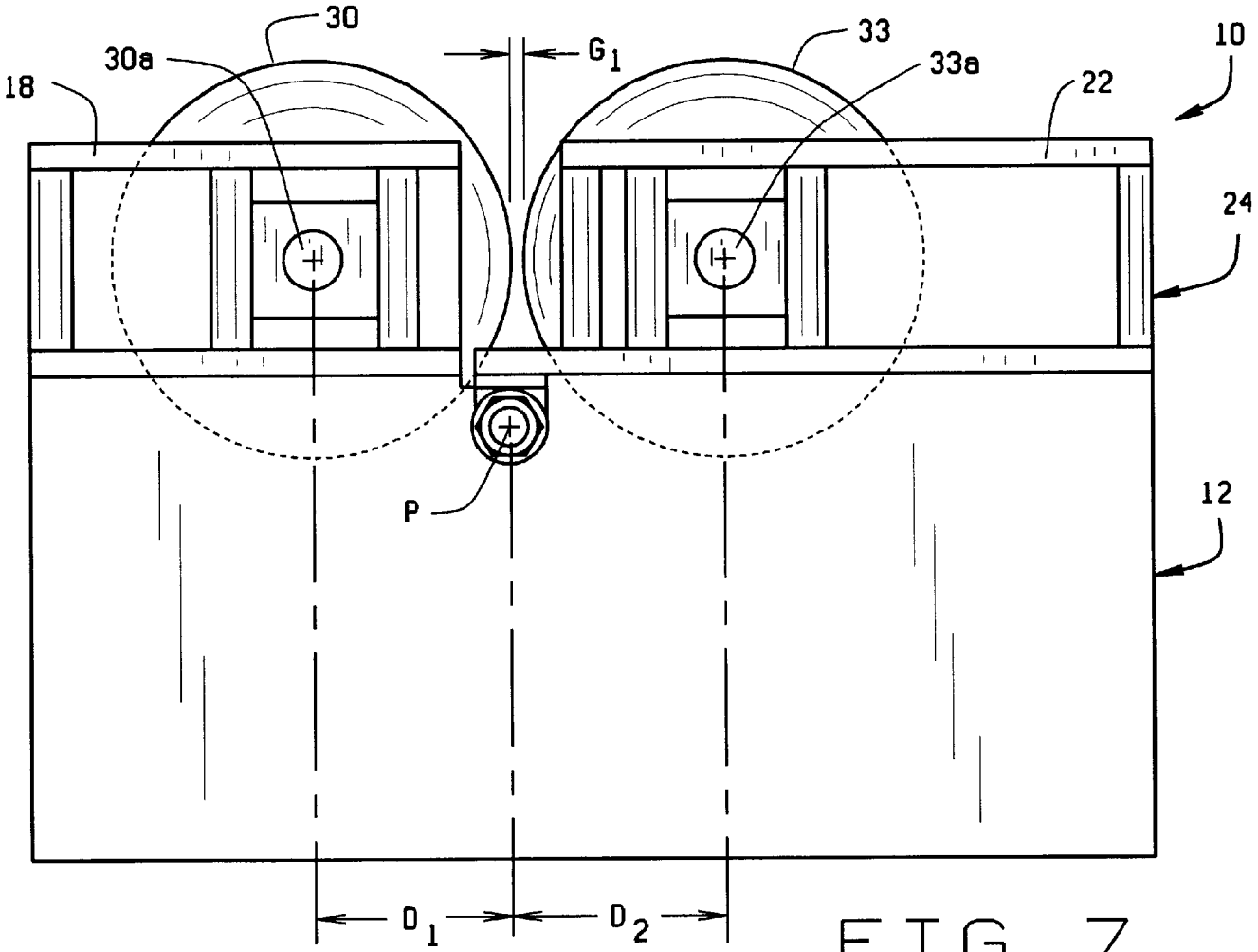
FIG. 7 is a side elevation, partially schematic, illustrating the relative positions of the opposed crushing rolls with the roll carriage in its lowered position.
Figure 8:
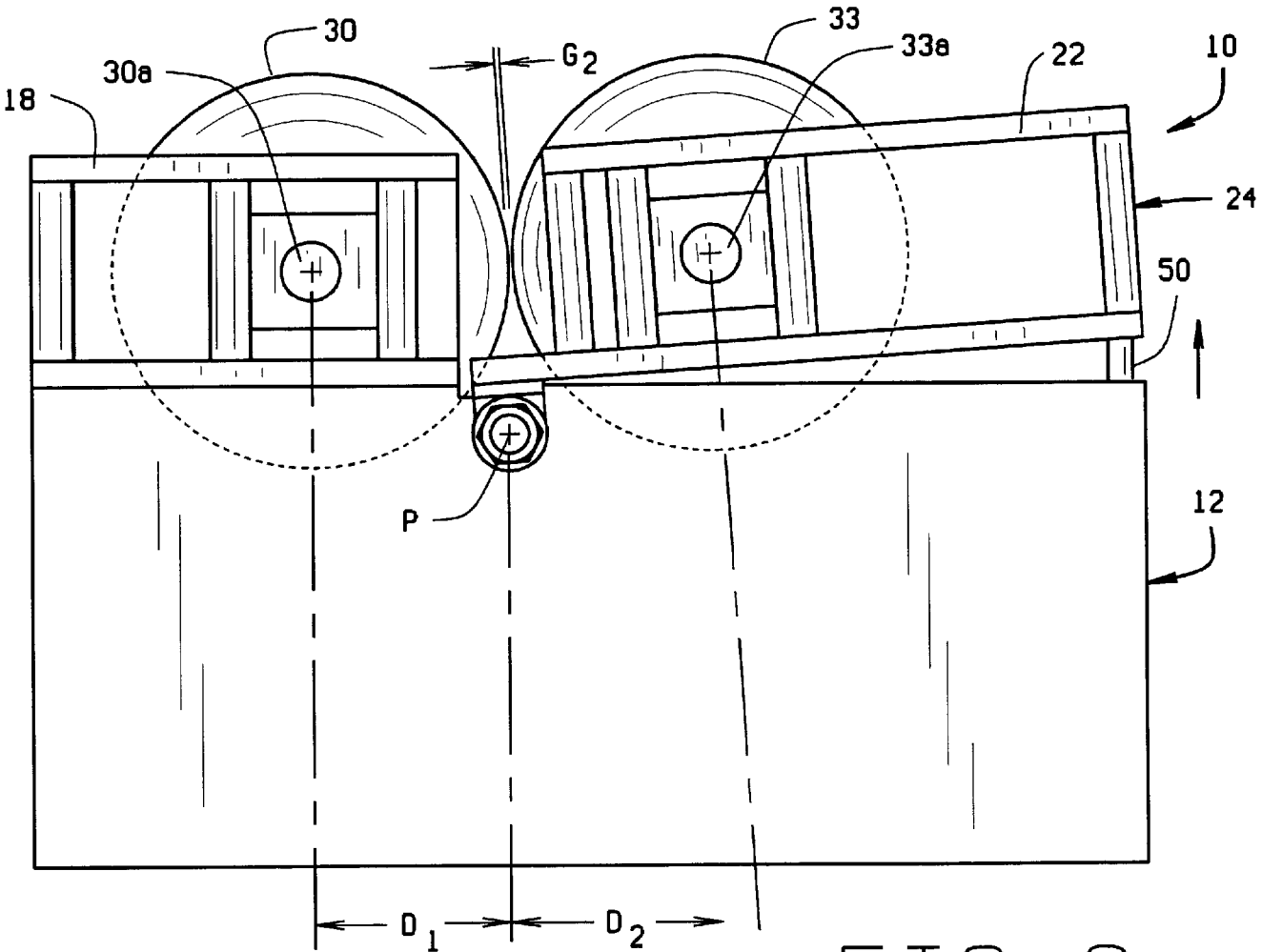
FIG. 8 is a side elevation, partially schematic, illustrating the relative positions of the opposed crushing rolls with the roll carriage in an elevated position.

FIGS. 7 and 8 graphically illustrate how the adjustment of the crushing gap G between opposed crushing rolls 30 and 33 is effected by the pivotal movement of the roll carriage 22. Pivot point P is positioned asymmetrically relative to axes of the crushing rolls, i.e., the distance D1 between the axis of roll 33 and pivot P is less that the distance D2 between the axis of roll 33 and pivot P. In FIG. 7, the roll carriage 22 is in a first or lowered position. In this position, the gap G1 between the rolls is at a wider predetermined dimension. The gap G1 is set by positioning of roll 33 in carriage 22 by the adjustment of the previously described hydraulically biased springs and stops, as known in the art. As illustrated in FIG. 8, elevation of the free end 24 of carriage 22 by actuator 50 effects rotation of the carriage about asymmetric pivot P. Roll 33 not only is elevated with the carriage, but it is moved closer to roll 30, resulting in a narrowed gap G2. It will be understood that G1 and G2 can be of any desired dimension, as required by the crushing application. Also, it will be understood that rolls 30 and 33 are not required to be aligned in a horizontal plane to perform the crushing function. The rolls function perfectly well when roll 33 is elevated relative to roll 30, as shown in FIG. 8.

Figure 9:
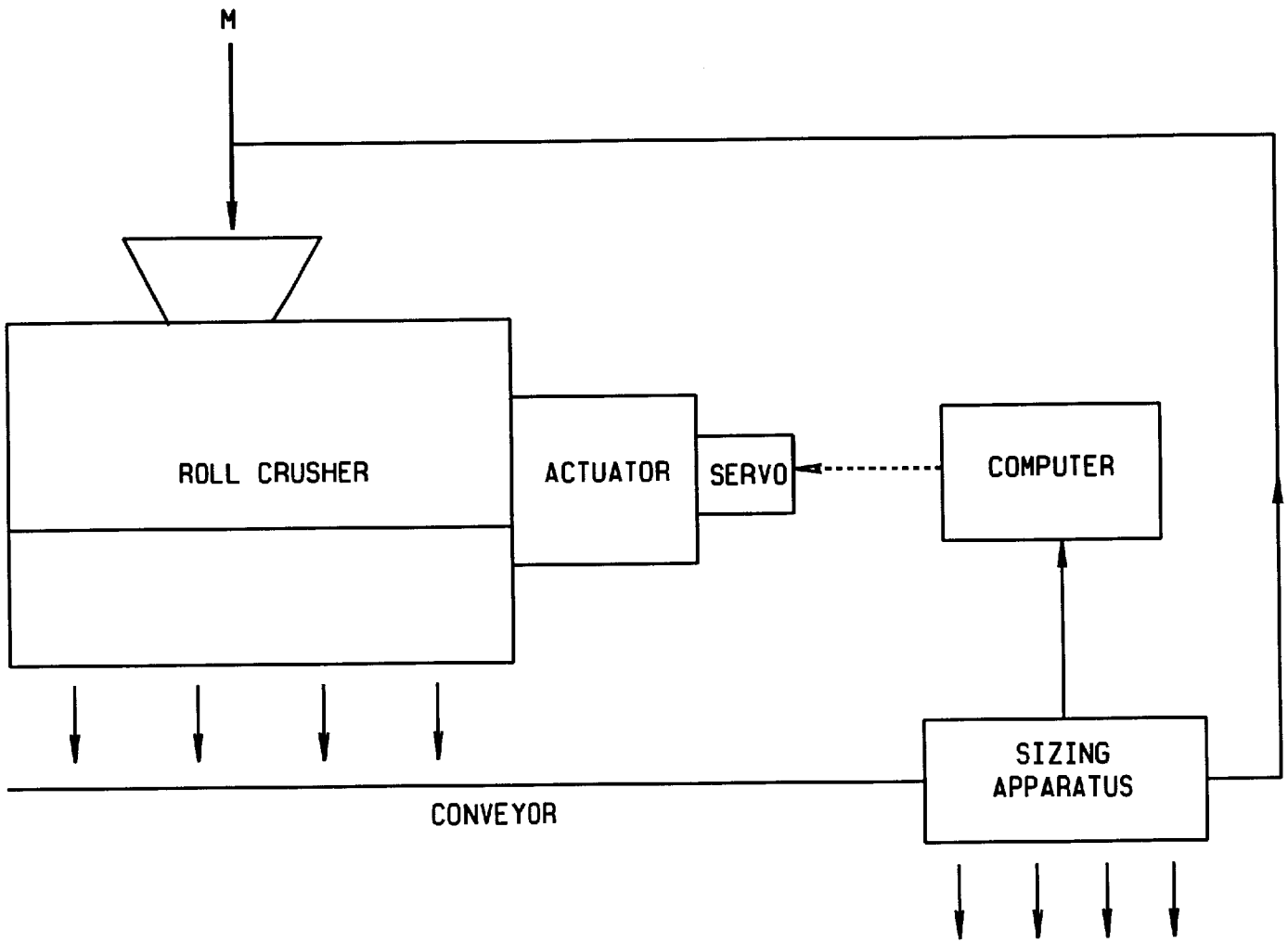
FIG. 9 is a diagram illustrating a closed loop system including an improved two roll crusher of the present invention Corresponding reference numeral indicate like structure throughout the various drawings.

As illustrated by FIG. 9, a roll crusher of the present invention can be employed in a closed loop system that provides for automated sampling and automated adjustment of gap size in response to crushed material sample size. The material M to be crushed is introduced to the roll crusher and is crushed. The crushed material is discharged onto a conveyer system and moved away from the crusher. The crushed material is directed to a sizing apparatus, such as a screening apparatus. Crushed material of the desired dimension passes for removal. If the crushed material is too large, for example, it is conveyed back to the crusher. The sizing apparatus can be operatively connected to a computer operated by appropriate software. Periodic sampling is conducted, for example by weighing retained crushed material. If an excess of crushed material is retained, it could indicate that the gap G is too wide. The computer program analyzes the sampling data and determines that the gap G should be narrowed. The computer is operatively connected to a servo motor designed to drive the actuator. The computer software is programmed to control the servo motor to operate the actuator so as to raise the crushing roll carriage to move the second crushing roll closer to the first crushing roll. Of course, the sizing apparatus and computer program can be designed to detect crushed material that is smaller than a target size and can automatically widen the crushing gap in the same manner. The foregoing description of one embodiment of a feedback loop system is for illustrative purposes only. Any closed loop system that incorporates appropriate apparatus for the sampling of crushed material and automated adjustment of the crushing gap in response to the sample size is intended to be within the scope of the invention and the appended claims.

Figure 3:
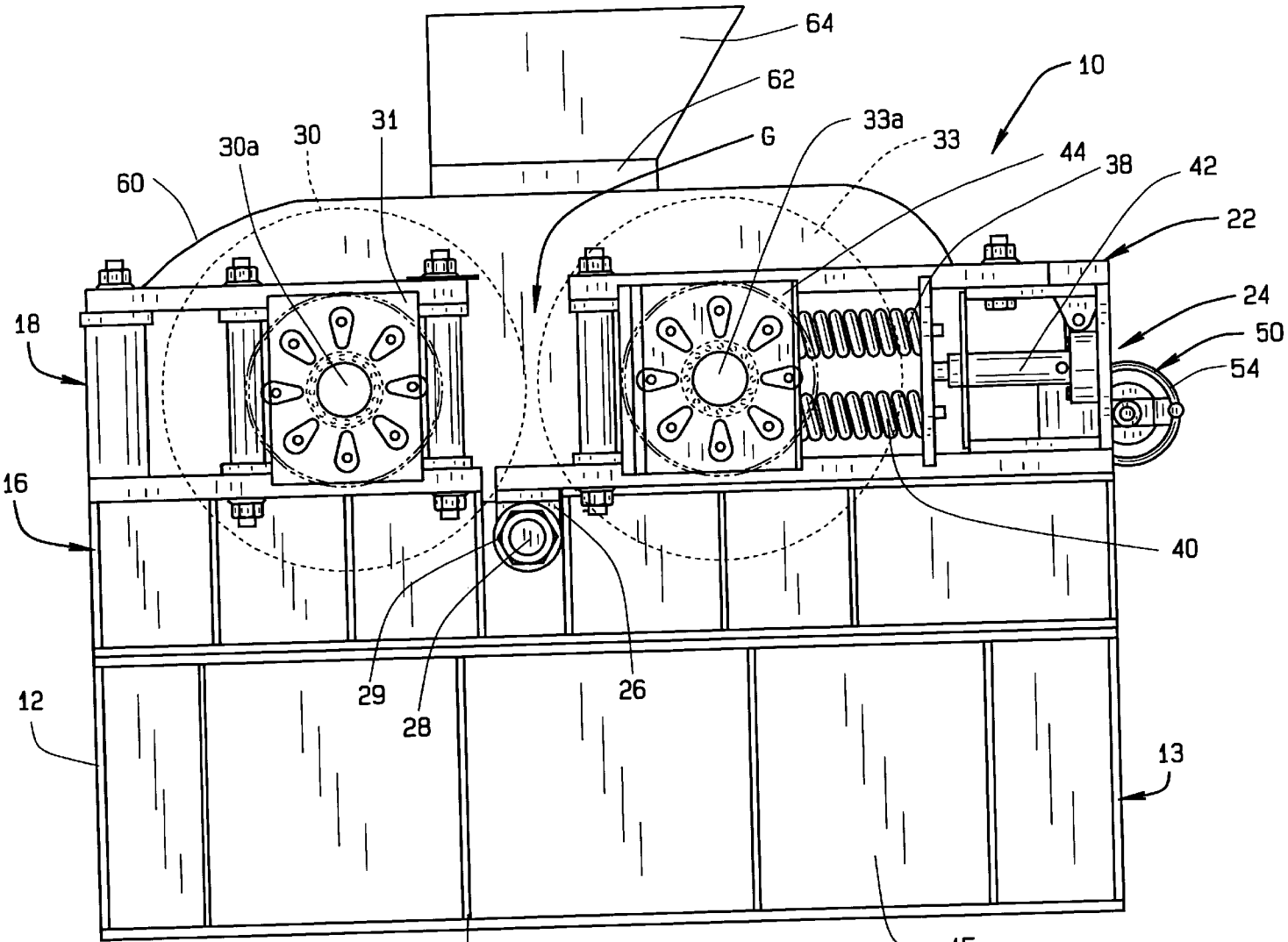
FIG. 3 is a side elevational view of the improved two roll crusher of the present invention with the roll carriage in a lowered position.
Figure 4:
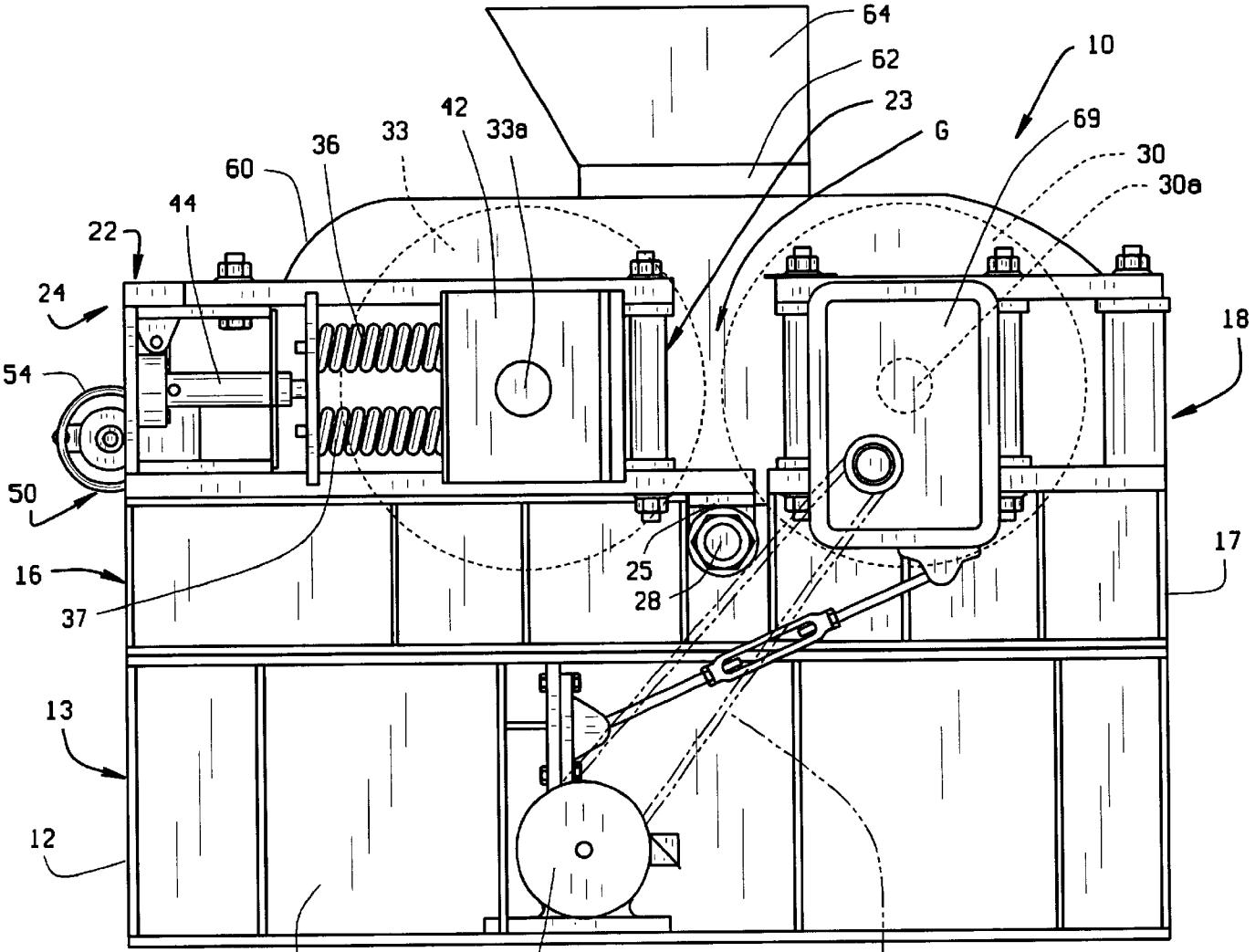
FIG. 4 is a side elevational view of the side opposite that shown in FIG. 3.

The present invention could be modified to provide adjustment between a crushing roll and opposed crushing beams in a single roll crusher. The crushing beams can be suspended between the walls of the crusher housing in the approximate position of crushing roll 30 shown in FIG. 3. A second, opposed crushing roll 33 would be positioned on the roll carriage 22, as previously described. The pivot axle 28 could be asymmetrically positioned with regard to the axis of crushing roll 33 and the horizontal center line of the crushing beams. That is, the pivot would be positioned toward the crushing beams. The roll carriage 22 can be moved about the pivot point, as previously described, to adjust the crushing gap between the crushing roll and the fixed crushing beams. It would be understood, however, that the rotatable crushing roll would be mounted on the roll carriage would be motor driven, by a motor 66 through a shaft mounted reducer 69 attached to shaft 33*a* of crushing roll 33. The drive mechanism could be assembled so as to allow pivotal movement of the driven roll. For example, a motor could be attached to the crushing roll 33 by a drive belt 68 having a tension pulley assembly to prevent slack in the drive belt as the crushing roll 33 is pivoted closer to the motor 66. Likewise, a drive chain and an adjustable tension sprocket assembly or derailleur may be employed.

Various changes and modifications may be made in the improved roll crusher of the present invention without departing from the scope of the appended claims. Therefore, the foregoing specification and accompanying drawings are intended to be illustrative only, and should not be construed in a limiting sense.

What is claimed is:

1. A two roll crusher comprising:

a main frame;

a first roll having a longitudinal axis rotatably mounted on the main frame;

a pivot on the main frame;

a carrier frame atop the main frame having a first end and a second end, said first end being pivotally attached to the main frame by the pivot and said second end being free to move relative to the main frame;

a second roll having a longitudinal axis rotatably mounted on the carrier frame, the first and second rolls being in an opposed spaced apart relationship defining a material crushing gap between the first and second rolls; and an actuator between the main frame and free end of the carrier frame to urge the carrier frame about the pivot so as to raise or lower the carrier frame on the main frame and move the second roll mounted on the carrier frame relative to the first roll so as to adjust the crushing gap between the first and second rolls.

2. The two roll crusher of claim 1 wherein the pivot is positioned on the main frame in an asymmetric position relative to longitudinal axes of the first and second rolls.

3. The two roll crusher of claim 1 wherein the actuator further comprises a jack apparatus.

4. The two roll crusher of claim 1 wherein the actuator further comprises a servomotor.

5. The two roll crusher of claim 1 wherein the actuator is controlled by a computer program.

6. The two roll crusher of claim 1 further comprising a housing on the main frame.

7. The two roll crusher of claim 1 further comprising a shroud on the frame, the shroud having a material inlet opening and a material discharge opening.

8. A roll type crushing apparatus comprising:

a base frame;

a first crushing roll rotatably mounted at a fixed position on said base frame;

a roll carriage frame on the base frame, said roll carriage having a first end of the frame attached to the base frame by a pivot and a second end of the frame being moveable relative to the base frame;

a second crushing roll rotatably mounted on the roll carriage frame, the first and second rotatably mounted crushing rolls in cooperative opposition defining a crushing gap of a predetermined dimension there between;

an actuator mechanism at the free end of the roll carriage frame for moving the roll carriage frame about the pivot, wherein movement of the roll carriage frame about the pivot moves the second crushing roll toward or away from the first crushing roll in an arc to change the predetermined dimension of the crushing gap between the first and second rotatably mounted crushing rolls; and a drive apparatus for driving the first and second rotatably mounted crushing rolls for a crushing operation.

9. In a roll crusher having a base frame, first and second rotatably mounted crushing rolls having parallel longitudinal axes in cooperative opposition to one another providing a material crushing gap between the rolls of an appropriate dimension, and an apparatus for driving the rolls for a crushing operation, the improvement comprising:

a roll carriage frame having a first end attached by a pivot to the base frame and a second end, the second rotatably mounted crushing roll being mounted on the roll carriage frame, said pivot being asymmetrically positioned between the parallel axes of the recited crushing rolls so that raising or lowering of the second end of the roll carriage frame effects a pivotal movement of the roll carriage to move the second rotatably mounted crushing roll relative the first rotatably mounted crushing roll to adjust the material crushing gap between the rolls without shutting down operation of the roll crusher.

10. The improvement of claim 9 wherein the pivot is positioned on the base frame nearer to the longitudinal axis of the first rotatably mounted crushing roll than to the longitudinal axis of the second rotatably mounted crushing roll.

11. The improvement of claim 9 further comprising an actuator for raising or lowering the unattached end of the roll carriage.

12. The improvement of claim 11 wherein the actuator is controlled by a software program.

13. The improvement of claim 11 wherein the actuator further comprises a jack assembly.

14. The improvement of claim 9 wherein the second rotatably mounted roll is spring biased within the roll carriage toward the first rotatably mounted roll so as to permit sufficient deflection of the rolls to pass non-crushable material between the rolls.

15. A two roll crusher comprising:

a frame including a base frame section and an upper frame section;

a housing on the frame having a material input opening and a crushed material output opening;

a first rotatably mounted crushing roll having a longitudinal axis mounted in a fixed position on the upper frame section within the housing;

a movable crushing roll carriage frame section on the main frame adiacent to the upper frame section and having a first end attached to the base frame section and a second end that is free to move relative to the main frame section;

a second rotatably mounted crushing roll having a longitudinal axis mounted on the crushing roll carriage frame section in cooperative opposition to the first rotatably mounted crushing roll providing a material crushing gap of a predetermined dimension between the rolls;

apparatus for adjusting a preset tension on the second crushing roll to control deflection of the second crushing roll when uncrushable material is introduced between the crushing rolls;

a pivot on the base frame section for the pivotal attachment of the first end of the crushing roll carriage frame section to the base frame, said pivot positioned on the main frame between the first and second crushing rolls at a point that is asymmetrical to the longitudinal axes of the first and second crushing rolls, wherein movement of the second end of the crushing roll carriage frame section effects movement of the crushing roll carriage frame about the pivot to changes the dimension of the crushing gap without affecting the preset tension on the second crushing roll;

an actuator assembly for effecting pivotal movement of the roll carriage frame section about the pivot thereby varying the material crushing gap between the rolls without changing the preset tension on the second crushing roll; and a drive apparatus operatively connected to the first crushing roll_for driving the first and second rotatably mounted crushing rolls for a crushing operation.

16. The two roll crusher of claim 15 wherein the actuator assembly is operatively associated with a computer program.

17. A closed loop crushing system, comprising:

a roll crusher having a base frame with a lower frame section and an upper frame section a first rotatably mounted crushing roll having an axis of rotation mounted in a fixed position on the base frame upper section;

a crushing roll carriage adjacent the upper frame section having a first end attached to the base frame adiacent a midpoint of the roll crusher and an unattached end;

a second rotatably mounted crushing roll having an axis of rotation carried_on the crushing roll carriage in cooperative opposition to the first rotatably mounted crushing roll providing a material crushing gap between the rolls dimensioned to crush material to a desired size;

a pivot on the base frame asymmetrically positioned between the respective axes of rotation of the first and second crushing rolls for pivotal attachment of the crushing roll carriage to the base frame;

a drive apparatus for driving the first and second rotatably mounted crushing rolls for a crushing operation;

an actuator at the unattached end of the crushing roll carriage for effecting pivotal movement of the roll carriage about the asymmetrically positioned pivot to change the material crushing gap between the rolls during operation of the crusher;

a conveyer system operatively associated with the two roll crusher discharge opening to convey crushed material away from the two roll crusher; and a separating apparatus operatively associated with the conveyer system for separating crushed material of a desired size and returning crushed material larger than the desired size to the conveyer for transport back to the two roll crusher.

18. The closed loop crushing system of claim 17 further comprising a computer operatively associated with the separating apparatus and the actuator assembly, said computer being programmed to obtain crushed material size data from the separating apparatus and to operate the actuator assembly to adjust the crushing gap between the rolls in response to the data.

19. The closed loop crusher system of claim 17 wherein the actuator assembly further comprises a servo motor operatively associated with the computer.

20. The closed loop crusher system of claim 17 wherein the separating apparatus is a sizing screen apparatus.

21. A roll crusher comprising:

a rectangular frame;

at least one laterally mounted crushing beam on the frame; and a crushing roll in cooperative opposition to the crushing beam providing a material crushing gap of a predetermined dimension between the crushing roll and the crushing beam, said crushing roll mounted on a movable roll carriage frame, said roll carriage frame having a rectangular configuration with a first end attached to the frame by a pivot positioned asymmetrically relative to the crushing beam and the crushing roll axis and an unattached second end wherein a movement of the unattached end of the roll carriage frame about the pivot moves the crushing roll in an arc relative to the crushing beam to effect a change in the dimension of the crushing gap between the crushing roll and the crushing beam.

22. The roll crusher of claim 21 further comprising an actuator for effecting pivotal movement of the roll carriage frame about the pivot.

23. The roll crusher of claim 21 further comprising a drive means for driving the crushing roll in a crushing operation.

24. The roll crusher of claim 22 employed in a closed loop crushing system.

25. A two roll crusher comprising:

a main frame;

a first roll having a longitudinal axis rotatably mounted on the main frame;

a carrier frame having a first end attached to the main frame and an unattached second end;

a second roll having a longitudinal axis rotatably mounted in the carrier frame, the first and second rolls being in an opposed spaced apart relationship defining a material crushing gap between the first and second rolls;

a pivot connecting said first end of the carrier frame to the main frame, said pivot asymmetrically positioned relative to the longitudinal axes of the first and second roll;

an actuator between the main frame and the unattached end of the carrier frame to urge the carrier frame about the pivot to move the second roll relative to the first roll so as to adjust the crushing gap between the first and second rolls wherein said adjustment can be made without stopping operation of the crusher.

26. A two roll crusher comprising:

a box-like main frame and a housing on the frame with a material inlet and a crushed material discharge outlet;

a first motor driven crushing roll is rotatably mounted on the frame within the housing;

a roll carriage having a generally rectangular frame positioned atop the main frame, one end of the roll carriage attached to the main frame near a midpoint of the main frame by pivot, the opposite end of the roll carriage being unattached;

a second crushing roll mounted on the roll carriage, the first and second crushing rolls being in an opposed, spaced apart relationship defining a material crushing gap between the first and second crushing rolls;

tensioning apparatus operatively connected to said second crushing roll to maintain an appropriate preset tension on the second crushing roll to control deflection of the roll when uncrushable material is introduced between the first and second crushing rolls;

said pivot connecting the crushing roll carriage to the main frame being asymmetrically positioned on the main frame nearer to the first crushing roll than to the second crushing roll, wherein movement of the roll carriage about the asymmetric pivot effects movement of the second crushing roll relative to the first crushing roll so as to adjust the crushing gap between the first and second crushing roll, said adjustment capable of being effected without stopping operation of the crusher and without affecting a change in the preset tension on the second crushing roll.

27. The two roll crusher of claim 26 wherein the crushing gap between the first and second crushing rolls can be adjusted from a gap of approximately ⅛ inch to approximately one inch.

* * * * *

UNITED STATES PATENT AND TRADEMARK OFFICE

CERTIFICATE OF CORRECTION

PATENT NO. : 6,685,118 B1
DATED : February 3, 2004
INVENTOR(S) : Robert M. Williams, Jr.

It is certified that error appears in the above-identified patent and that said Letters Patent is hereby corrected as shown below:

Column 6,
Line 38, replace “servomotor” with -- servo motor --

Column 7,
Line 48, replace “adiacent” with -- adjacent --

Column 8,
Line 12, replace “roll_for” with -- roll for --.
Line 24, replace “adiacent” with -- adjacent --
Line 27, replace “carried_on” with -- carried on --

Signed and Sealed this

Thirteenth Day of April, 2004

JON W. DUDAS
*Acting Director of the United States Patent and Trademark Office*